US009609992B2

(12) United States Patent
Coxon

(10) Patent No.: US 9,609,992 B2
(45) Date of Patent: Apr. 4, 2017

(54) JEWELLERY CLEANING WIPE

(71) Applicant: Andrew Coxon, London (GB)

(72) Inventor: Andrew Coxon, London (GB)

(73) Assignee: FOR YOUR DIAMONDS ONLY LTD, London (GB)

( * ) Notice: Subject to any disclaimer, the term of this patent is extended or adjusted under 35 U.S.C. 154(b) by 0 days.

(21) Appl. No.: 14/212,843

(22) Filed: Mar. 14, 2014

(65) Prior Publication Data

US 2014/0283874 A1 Sep. 25, 2014

(30) Foreign Application Priority Data

Mar. 21, 2013 (GB) ..... 1305217.0

(51) Int. Cl.

| | |
|---|---|
| ***B08B 7/00*** | (2006.01) |
| ***A47L 13/17*** | (2006.01) |
| ***C11D 3/14*** | (2006.01) |
| ***C11D 17/04*** | (2006.01) |
| ***C11D 3/20*** | (2006.01) |
| ***D06M 11/74*** | (2006.01) |

(52) U.S. Cl.

CPC ..... *A47L 13/17* (2013.01); *C11D 3/14* (2013.01); *C11D 3/2017* (2013.01); *C11D 17/049* (2013.01); *D06M 11/74* (2013.01)

(58) Field of Classification Search

CPC ..... B24D 3/00; B24D 11/00; B24D 11/001; B08B 1/00; B08B 1/001; B08B 1/006; B08B 2240/00; D06M 11/74; D06N 2211/08; A47L 13/10; A47L 13/16; A47L 13/17; A47L 25/00; A47L 25/02

USPC .... 451/41, 59, 526; 442/59, 417; 15/104.93, 15/208, 209.1, 210.1, 229.11; 134/6, 7, 134/42

See application file for complete search history.

(56) References Cited

U.S. PATENT DOCUMENTS

| | | | | |
|---|---|---|---|---|
| 3,574,580 | A | 4/1971 | Stromberg et al. | |
| 4,339,281 | A | 7/1982 | Chio | |
| 5,133,792 | A * | 7/1992 | Purohit et al. | 134/26 |
| 5,306,439 | A | 4/1994 | Lockhart | |
| 5,921,856 | A * | 7/1999 | Zimmer | 451/539 |
| 6,110,573 | A * | 8/2000 | Kobayashi et al. | 428/219 |
| 6,258,721 | B1 | 7/2001 | Li et al. | |
| 6,645,930 | B1 * | 11/2003 | Wallis et al. | 510/438 |
| 2002/0017063 | A1 * | 2/2002 | Beitel et al. | 51/307 |
| 2004/0031205 | A1 * | 2/2004 | Ohishi | 51/295 |
| 2005/0026798 | A1 | 2/2005 | Hollander | |
| 2005/0220829 | A1 | 10/2005 | Sung et al. | |
| 2006/0211340 | A1 * | 9/2006 | Thysell | B24B 7/186 451/41 |
| 2007/0184121 | A1 | 8/2007 | Sung | |
| 2008/0293332 | A1 * | 11/2008 | Watanabe et al. | 451/37 |
| 2009/0326160 | A1 * | 12/2009 | Kimura | 525/303 |
| 2010/0254915 | A1 | 10/2010 | Kao | |
| 2010/0293865 | A1 * | 11/2010 | Watanabe et al. | 51/297 |
| 2011/0305917 | A1 * | 12/2011 | Mineif | 428/550 |
| 2012/0094581 | A1 | 4/2012 | Sharma | |
| 2012/0220207 | A1 * | 8/2012 | Dean | B24D 11/00 451/490 |
| 2012/0304693 | A1 | 12/2012 | Rizzo | |
| 2014/0057533 | A1 * | 2/2014 | Long | B24B 7/228 451/41 |
| 2014/0283874 | A1 * | 9/2014 | Coxon | 134/6 |

FOREIGN PATENT DOCUMENTS

| | | | |
|---|---|---|---|
| CN | 102631164 A | | 8/2012 |
| SU | 943264 | * | 7/1982 |
| WO | WO 2006/083570 A2 | | 8/2006 |

* cited by examiner

*Primary Examiner* — Bibi Carrillo

(74) *Attorney, Agent, or Firm* — Saliwanchik, Lloyd & Eisenschenk

(57) ABSTRACT

It is surprisingly found that when diamond particles are embedded into an alcohol wipe, the cleansing wipe that is formed is extremely useful at cleaning diamond jewellery in the home. It is also surprising that, given the abrasive nature of diamond, the diamond particles result in a satisfactory clean without causing any damage to the surface of the diamond being cleaned. The final result is that the cleaned diamond has recovered most of its original fire, life and brilliance.

8 Claims, No Drawings

JEWELLERY CLEANING WIPE

FIELD OF THE INVENTION

The present invention relates to cleansing wipes suitable for cleaning diamonds, for example diamond jewellery.

CROSS-REFERENCE TO A RELATED APPLICATION

This application claims priority to Great Britain Application No. 1305217.0, filed Mar. 21, 2013, which is incorporated herein by reference in its entirety.

BACKGROUND OF THE INVENTION

Diamonds are commonly found in jewellery, and are the most favoured stone for engagement rings. They are chosen for their hardness, value and brilliance. When choosing a diamond, it is important to take into account the "four C's"; carat weight, clarity, cut and colour. Each of these features affects the overall appearance of the stone.

To most wearers, the "four C" credentials of a diamond are secondary to whether the diamond "sparkles" and has fire, life and brilliance. This is determined to some extent by cut, clarity and transparency, but also by how clean the surface of the diamond is. A diamond rapidly loses its brilliance when it becomes opaque through contact with substances such as moisturising lotions, and eventually becomes dirty when skin particles and dust adhere and accumulate behind the diamond. This will not wash off with water.

Since diamonds are favoured for engagement rings, which are worn every day, they very quickly become dirty. Often the wearers see a reduction in fire, life and brilliance within just a few days of constant wear. Diamonds have a very high affinity for grease, and day-to-day activities such as showering, doing the washing up and applying hand cream, all leave a residue on the diamond, which causes it to become dull. Oils and greases are hydrocarbons, which tend to stick well to surfaces that do not contain oxygen. A diamond surface, therefore, which is pure carbon, is ideal.

The most effective way to clean a diamond is to take it to a jeweller, and have it professionally cleaned. Jewellers often have specialist cleaning solutions and ultrasonic cleaning machines at their disposal, which are very effective. However, this often incurs a fee, and it may not be practical for a person to take all of their diamond jewellery to the jewellers on a very regular basis. Additionally, people are sometimes embarrassed by the dirt that builds up on their jewellery, particularly in the case of diamond earrings, and often prefer to clean their jewellery at home.

Over the years, a number of diamond jewellery cleaning methods have been used in the home. For example, a solution of washing up liquid in water can often be effective, as can soaking the jewellery in alcohol, such as gin. One method that has been reported is the use of effervescent denture cleaners, such as Steradent® or Poligrip®. However, many people would be very hesitant to use this method. Firstly, it is not recommended by the manufacturers, and secondly, tests show that metals, such as 18K to 9K gold, and also silver will tarnish upon exposure to most dental cleaning products. Therefore this method would certainly not be considered suitable for all diamond jewellery.

Alcohol cleaning wipes also exist, and they are known to be able to clean diamond jewellery. However, the cleaning results can be less than satisfactory.

Although several cleaning methods are known in the art, no satisfactory home cleaning method has been found which achieves results close to that of a professional clean by the jeweller in their shop.

SUMMARY OF THE INVENTION

It is surprisingly found that when diamond particles are embedded into an alcohol wipe, the cleansing wipe that is formed is extremely useful at cleaning diamond jewellery in the home. The alcohol solution works to remove opaqueness and most of the dirt, while the diamond particles further work to improve the appearance of the diamond. It is believed that this is achieved in part by the absorption of the fine diamond powder or dust by the oils and grease on the surface of the diamond. This absorption of fine diamond particles greatly increases the cleaning action of the alcohol wipe.

It is also surprising that, given the abrasive nature of diamond, the diamond particles result in a satisfactory clean without causing any damage to the surface of the diamond being cleaned. Instead, they appear to have a polishing effect on the diamond, which is enhanced by the action of the cleansing wipe. It is also surprising that the diamond particles do not stick to the surface of the diamond, but are instead easily removed by the alcohol wipe. The final result is that the cleaned diamond has recovered most of its original fire, life and brilliance.

According to a first aspect, a cleansing wipe, comprises a substrate and, absorbed therein, a suspension of an alcohol solution and diamond particles with a median equivalent volumetric diameter (Dv50) of less than 40 μm.

According to a second aspect, a package comprises a wipe as defined above.

According to a third aspect, a method of cleaning a diamond item comprises rubbing or wiping the item with a cleansing wipe as defined above.

According to a fourth aspect, a method of preparing a cleansing wipe as defined above, comprises soaking a substrate in a suspension of an alcohol solution and diamond particles with a median equivalent volumetric diameter (Dv50) of less than 40 μm until the substrate is saturated.

DESCRIPTION OF THE PREFERRED EMBODIMENTS

A cleansing wipe of the invention comprises a substrate. The term "substrate" is used because a solution/suspension is absorbed into the wipe, to allow it to clean effectively. Therefore, the substrate may be formed of any suitable material, which allows saturation with an alcohol solution. Cotton or synthetic cloths are two examples. It will be apparent that the substrate should be absorbent.

In a preferred embodiment, the substrate is formed from a non-woven fabric, more preferably spun lace. Preferably, the non-woven fabric substrate comprises a cotton fibre or polypropylene fibres. Without wishing to be bound by theory, non-woven fabrics are preferred as they do not leave fibres on the surface of the diamond and they do not snag on the claws of jewellery.

A suspension of the invention comprises an alcohol solution and diamond particles with a median equivalent volumetric diameter (Dv50) of less than 40 μm. The alcohol is defined herein as a "solution" as the alcohol may be dissolved in water. The term "suspension" is used because the diamond particles obviously do not dissolve in the alcohol solution. However, the diamond particles are so fine that they are suspended in the alcohol solution like a "fine smoke", and once the alcohol solution has been soaked/absorbed onto the substrate, the diamond particles become adsorbed onto the surface of the substrate. Without wishing to be bound by theory, they may be held within the matrix of the substrate by physical forces.

An alcohol solution of the invention is preferably a solution of a neat alcohol in water, preferably deionised water. The alcohol is preferably in a concentration of at least 40, 50, 60, 70, 80, 90 or 100%. Any alcohol is suitable for use in the invention, but it is preferred that the alcohol is ispropyl alcohol, since it cleans without leaving any streaks.

Preferably, a cleaning wipe of the invention has dimensions of approximately 6 cm×3 cm. When packaged, it is preferably folded to a 3 cm square and slotted into a packet, which may be made of a plastics material. Preferably, the plastic packed it fitted snugly to the wipe and has a thickness of less than 5 mm.

As used herein, diameter means equivalent volumetric diameter. This is the diameter of a spherical particle having the same constitution and volume as the particle being measured. This is a standardised technique to take into account the fact that not all particles are perfect spheres.

The equivalent volumetric diameter is preferably measured by laser diffraction. Light from a laser is shone into a cloud of particles, which are suspended in a transparent gas such as air. The particles scatter the light; smaller particles scattering the light at larger angles than bigger particles. The scattered light can be measured by a series of photodetectors placed at different angles. This is known as the diffraction pattern for the sample. The diffraction pattern can be used to measure the size of the particles using well documented light scattering theory. The particles are assumed to be spherical but few particles are actually spherical. The particle diameters are calculated from the measured volume of the particle, but assume a sphere of equivalent volume.

In the present invention, a composition may be said to comprise particles having a median equivalent volumetric diameter (Dv50) of x μm. This is a statistically derived figure that is understood in the art and this means that, in a particular sample, 50% of the particles will have an equivalent volumetric diameter of x μm or greater and 50% of the particles will have an equivalent volumetric diameter of less than x μm. The skilled person will know how to calculate the Dv50. One such method for measuring Dv50 is given in "ISO 9276-2:2001: Representation of results of particle size analysis—Part 2: Calculation of average particle sizes/diameters and moments from particle size distributions", which is incorporated herein by reference.

The Dv50 (median equivalent volumetric diameter) can also be measured by dynamic light scattering (DLS).

The diameter of the diamond particles is critical. If the diamond particles are too large, then they may damage the diamond by scratching it, or they may cause it to become loose in its setting. Furthermore, it is necessary for the diamond particles to have a large combined surface area, so that the maximum amount of grease can be polished from the surface of the diamond being cleaned. Therefore, the diamond particles should have a Dv50 of less than 40 μm. Preferably, the diamond particles have a Dv50 of less than 35, 30, 25 or 20 μm. More preferably, the diamond particles have a Dv50 of less than 10 μm 9, 8, 7, 6, 5, 4, 3, 2 or 1 μm.

In a preferred embodiment, the Dv50 of the diamond particles lies within a particular range. Preferred lower limits are 0, 1 nm, 10 nm, 50 nm, 100 nm, 500 nm, 1 nm, 2 nm 10 nm or 100 nm. Preferred upper limits are 2 μm, 3 μm, 4 μm, 10 μm, 15 μm, 20 μm, 25 μm, 30 μm or 35 μm. Any of the aforementioned lower limits can be combined with the aforementioned upper limits.

Preferably, if the Dv50 is expressed as x μm, 75% of the particle diameters are x±20%, preferably x±10%, more preferably x±5%. Preferably, 80, 85, 90, 95 or 98% of the particles are within the specified range.

The diamond dust (particles) that is used in the invention may be natural or synthetic. Preferably, the diamond particles that are used in the present invention are from natural diamonds.

Natural diamond dust (particles) is commercially available. Once source is the Industrial Diamond Corporation, Hatton Garden, London EC1. This dust is the by-product of the rounding process of larger natural rough diamonds within metal cylinders. The dust is recovered by cleaning the metal cylinders with an acid, which does not affect the diamonds, but does release the dust which has become impregnated into the metal during the rounding process.

Examples of sizes (expressed in μm) of natural diamond dust that are commercially available, and which are therefore suitable for use in the invention are: 0-1, 0-2, 1-3, 2-3, 2-4, 3-5, 4-8, 5-10, 6-12, 7-10, 8-15, 10-20, 15-25, 20-40, 30-40.

A range of sizes of synthetic nano diamond dust is also available commercially.

Preferably, a composition of the invention comprises a fragrance.

In a preferred embodiment, a wipe according to the invention contains a suspension comprising between 40% to 90% alcohol and water In a preferred embodiment, a wipe according to the invention contains a suspension comprising 0.0001 wt. % to 0.1 wt. % diamond particles with a Dv50 of less than 40 μm and 40-90 wt. % of an alcohol.

Without wishing to be bound by theory, even the presence of a very small amount of diamond particles makes a large difference to the cleaning action. This is believed to be due to the very large surface area of the diamond particles, and the fact that they have such a high affinity for grease.

A cleansing wipe of the invention may be prepared by soaking a suitable substrate, such as a spun lace, into a suspension of an alcohol solution and fine diamond particles. The wipe should be soaked in the solution until it is saturated.

EXAMPLE 1

A spun lace cloth (6 cm×3 cm) was soaked in a suspension of 70% isopropyl alcohol (and 30% deionised water) and 0.001% natural diamond powder. The size of diamond powder added was 0-2 micron with an average particle size of 1 micron.

The diamond particles were evenly suspended in the alcohol solution, and were therefore evenly impregnated onto the cloth when the cloth was soaked in the suspension.

To test the efficacy of the wipe, a diamond ring was covered in Vaseline until it became dull and opaque. The wipe was then used to clean the diamond and all Vaseline appeared to the naked eye to be removed. The natural life, fire and brilliance of the diamond were restored.

The invention claimed is:

1. A method of cleaning a diamond item comprising rubbing or wiping the item with a cleansing wipe consisting of an absorbent foldable cloth substrate that is soaked with an aqueous suspension consisting of water, an alcohol solution, and diamond particles, wherein the diamond particles have a median equivalent volumetric diameter (Dv50) of less than 40 μm, wherein at least 80% of the diamond particles have an equivalent volumetric diameter of less than 40 μm, and wherein the aqueous suspension consists of water, 0.0001 wt. % to 0.1 wt. % diamond particles, and wherein the concentration of alcohol in the alcohol solution is 40-90 wt. %, such that the diamond particles are suspended in a matrix of the substrate and do not scratch the gem during cleaning.

2. The method according to claim 1 wherein the diamond particles have a Dv50 of between 1 nm and 20 μm.

3. The method, according to claim 1, wherein the alcohol is isopropyl alcohol.

4. The method, according to claim 1, wherein the matrix of the substrate is a non-woven fabric.

5. The method, according to claim 1, wherein said wipe has dimensions of approximately 6 cm by 3 cm.

6. The method, according to claim 5, wherein the wipe is contained in a package.

7. The method, according to claim 6, wherein the package is a plastic packet of less than 5 mm thickness.

8. The method according to claim 7, wherein the wipe is folded in the plastic packet to dimensions of 3 cm×3 cm, and wherein the package fits snugly around the wipe.

* * * * *